US009581371B2

(12) United States Patent
Hung et al.

(10) Patent No.: US 9,581,371 B2
(45) Date of Patent: Feb. 28, 2017

(54) SYSTEM FOR OPERATING AN HVAC SYSTEM HAVING TANDEM COMPRESSORS

(71) Applicant: Lennox Industries Inc., Richardson, TX (US)

(72) Inventors: Der-Kai Hung, Dallas, TX (US); Harold Gene Havard, Jr., Carrollton, TX (US); Rosa Maria Leal, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 462 days.

(21) Appl. No.: 14/221,862

(22) Filed: Mar. 21, 2014

(65) Prior Publication Data

US 2015/0267953 A1 Sep. 24, 2015

(51) Int. Cl.
*F25B 49/02* (2006.01)

(52) U.S. Cl.
CPC ..... *F25B 49/022* (2013.01); *F25B 2600/02* (2013.01); *F25B 2600/21* (2013.01); *F25B 2600/23* (2013.01); *F25B 2700/2117* (2013.01)

(58) Field of Classification Search
CPC . F25B 49/022; F25B 2600/02; F25B 2600/21; F25B 2600/23; F25B 2600/11; F25B 47/006; F25D 21/02; F25D 21/04
See application file for complete search history.

(56) References Cited

U.S. PATENT DOCUMENTS 4,105,064 A * 8/1978 Del Toro ..... F24F 3/065 165/233
4,157,649 A * 6/1979 Bussjager ..... F25B 13/00 62/160
4,474,026 A * 10/1984 Mochizuki ..... F25B 5/00 62/157
4,506,516 A * 3/1985 Lord ..... F04B 49/02 219/486
2006/0174640 A1* 8/2006 Caskey ..... F25B 49/027 62/183
2007/0234746 A1* 10/2007 Puranen ..... F24F 11/0086 62/129
2007/0251251 A1* 11/2007 Wojdyla ..... B60H 1/321 62/180
2008/0116289 A1* 5/2008 Lochtefeld ..... F24F 3/06 237/81
2008/0276637 A1* 11/2008 Lifson ..... F25B 49/025 62/228.4
2009/0084120 A1* 4/2009 Meier ..... B64F 1/362 62/129
2010/0024452 A1* 2/2010 Lifson ..... F25D 21/06 62/154
2010/0071391 A1* 3/2010 Lifson ..... F25B 1/10 62/115
2010/0186433 A1* 7/2010 Galante ..... F04C 18/0215 62/115

(Continued)

*Primary Examiner* — Allana Lewin Bidder
*Assistant Examiner* — Kun Kai Ma
(74) *Attorney, Agent, or Firm* — Baker Botts L.L.P.

(57) ABSTRACT

The present invention provides for a system for operating a heating, ventilation, and air conditioning (HVAC) system. A controller operates compressors in tandem connected to an evaporator. In response to detection of a pre-freezing condition of in the coils of the evaporator, the controller adjusts an operating condition of the HVAC system.

19 Claims, 7 Drawing Sheets

(56) References Cited

U.S. PATENT DOCUMENTS

| | | | | |
|---|---|---|---|---|
| 2010/0251738 | A1* | 10/2010 | Takegami | F25B 41/046 62/228.5 |
| 2011/0314845 | A1* | 12/2011 | Lifson | F25B 49/022 62/115 |
| 2012/0167602 | A1* | 7/2012 | Taras | F25B 49/02 62/115 |
| 2013/0098086 | A1* | 4/2013 | Sillato | F25B 49/02 62/184 |

* cited by examiner

SYSTEM FOR OPERATING AN HVAC SYSTEM HAVING TANDEM COMPRESSORS

CROSS-REFERENCED APPLICATIONS

This application relates to co-pending U.S. patent application Ser. No. 14/221,843, entitled SYSTEM FOR CONTROLLING OPERATION OF AN HVAC SYSTEM HAVING TANDEM COMPRESSORS, filed Mar. 21, 2014, which is hereby incorporated by reference.

BACKGROUND OF THE INVENTION

Field of the Invention

The present invention relates to control systems used in heating, ventilation, and air conditioning (HVAC) systems and, more particularly, to a system for controlling operation of an HVAC system having a tandem compressor assembly.

Background

In an HVAC system, an evaporator removes heat from an enclosed space that is to be cooled. It is important to keep coils of the evaporator warm enough to prevent freezing of water condensation on the coils due to the low temperature of refrigerant within the coils. In other situations, the coils may become cold due to a low refrigerant charge. In some HVAC systems, a freeze stat is utilized to detect a freezing condition in the evaporator coils. In response to a freezing condition, a control system of the HVAC system shuts down the HVAC system to prevent damage to a compressor and other components of the HVAC system. What is needed are improved systems, devices, and methods for maintaining the evaporator of an HVAC system in an operational condition.

SUMMARY

The present invention provides a system for operating an HVAC system with tandem compressors. In response to detection of a pre-freezing condition in evaporator coils of the HVAC system, a controller adjusts an operating condition of the HVAC system.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, details concerning well-known features and elements have been omitted inasmuch as such details are not considered necessary to obtain a complete understanding of the present invention, and are considered to be within the understanding of persons of ordinary skill in the relevant art.

Figure 1:
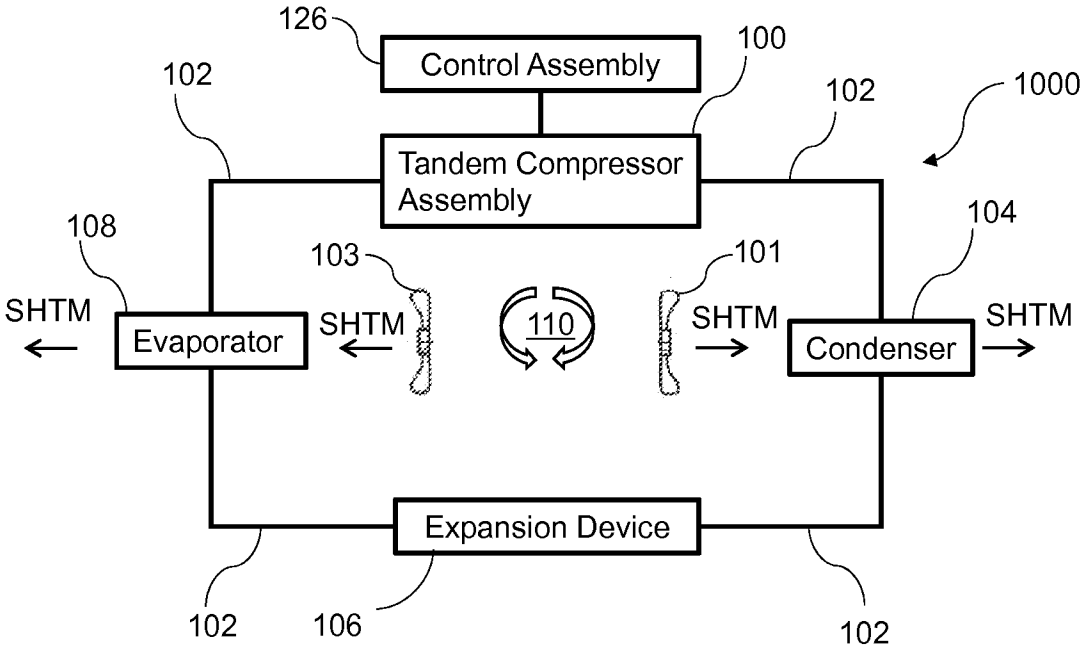
FIG. 1 illustrates an HVAC system having a tandem compressor assembly.

Referring to FIG. 1, a tandem compressor assembly 100 may be configured to operate in a heating, ventilation, and air conditioning system (HVAC) 1000. The tandem compressor assembly 100 may drive refrigerant, as a first heat transfer media, through flow lines 102, which connect the tandem compressor assembly 100 to a condenser 104, to an expansion device 106, and to an evaporator 108. The flow lines 102 may return refrigerant back to the tandem compressor assembly 100 in a cooling or heating circuit 110, depending on the direction in which the refrigerant flows within the flow lines 102.

The HVAC system 1000 may utilize a second heat transfer media in the cooling and heating circuit 110. In some embodiments, the second heat transfer media (labeled "SHTM" in FIG. 1) is air. A flow assembly 142 (shown in FIG. 4) may comprise a first fluid moving device 101, such as a blower or a fan, configured to move air, as the second heat transfer media, through the condenser 104, and a second fluid moving device 103, such as a blower or a fan, configured to move air through the evaporator 108. Each fluid moving device 101, 103 may comprise an adjustable speed for setting and changing the flow rate of the second heat transfer media. The HVAC system 1000 may be configured for refrigeration, cooling, and heating in the cooling or heating circuit 110 for maintaining a desired temperature profile in an enclosed space, such as a home or business.

In other embodiments, the HVAC system 1000 may utilize a different heat transfer media instead of air, for example water or other gas or fluid which transfers heat with refrigerant flowing in the evaporator 108 or condenser 104. In the case of the second heat transfer media being a fluid, the fluid moving devices 101, 103 used in FIG. 1 may comprise pumps configured to move fluid through the condenser 104 and evaporator 108.

Figure 2:
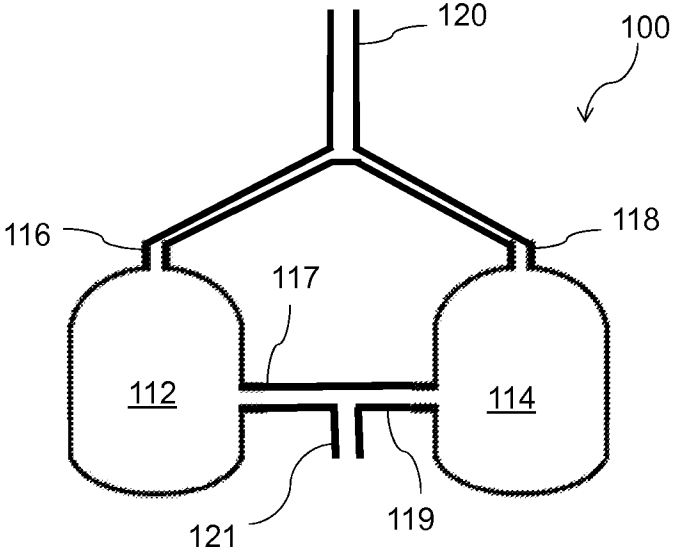
FIG. 2 shows a schematic of a tandem compressor assembly.

Referring to FIG. 2, the tandem compressor assembly 100 may comprise a first compressor 112 and a second compressor 114 operationally connected in tandem for adjustment of the total heat transfer capacity of the HVAC system 1000. It will be understood by persons of ordinary skill in the art that the tandem compressor assembly 100 may comprise two or more compressor units operated in tandem, for example a three compressor system.

The tandem compressor assembly 100 allows the first compressor 112 or the second compressor 114 to be operated while the other compressor 114 or 112, respectively, is turned off (referred to as a "one-compressor configuration") during periods of low heat transfer demand. The tandem compressor assembly 100 also allows both compressors 112 and 114 to be operated at the same time (referred to as a "two-compressor configuration") during periods of high heat transfer demand.

The tandem compressor assembly 100 may further be configured to operate in the one-compressor configuration in response to detection of an abnormal operating condition in the HVAC system 1000. For example, the tandem compressor assembly 100 may be operated in a one-compressor configuration in response to a detection of an abnormal temperature condition in the coils 105 of the evaporator 108.

In some embodiments, one or more of the compressors 112, 114 in the tandem compressor assembly 100 may comprise a variable capacity, allowing for further adjustment of heat transfer by the HVAC system 1000 to meet the environmental demands. For example, the tandem compressor assembly 100 may be operated in a first stage "Y1" and a second stage "Y2," as referred to in FIG. 6. In the first stage Y1, the one or more of the compressors 112, 114 may be operated at reduced capacity to accommodate a lower heat transfer demand. In the second stage Y2, the one or more of the compressors 112, 114 may be operated at or near full capacity to accommodate a higher heat transfer demand.

Referring to FIG. 2, the first compressor 112 and the second compressor 114 of the tandem compressor assembly 100 may share one or more portions of flow lines 102 in the same heating or cooling circuit 110. By example, a first discharge line 116 of the first compressor 112 and a second discharge line 118 of the second compressor 114 may be connected by a common discharge line 120. Refrigerant pumped from first compressor 112 and the second compressor 114 may flow from each respective discharge line 116, 118 into the common discharge line 120. In a similar manner, a first suction line 117 and a second suction line 119 may be connected by a common suction line 121. It will be understood by persons of ordinary skill in the art that the first compressor 112 and the second compressor 114 may share other portions of the flow lines 102 in the circuit 110.

Figure 3:
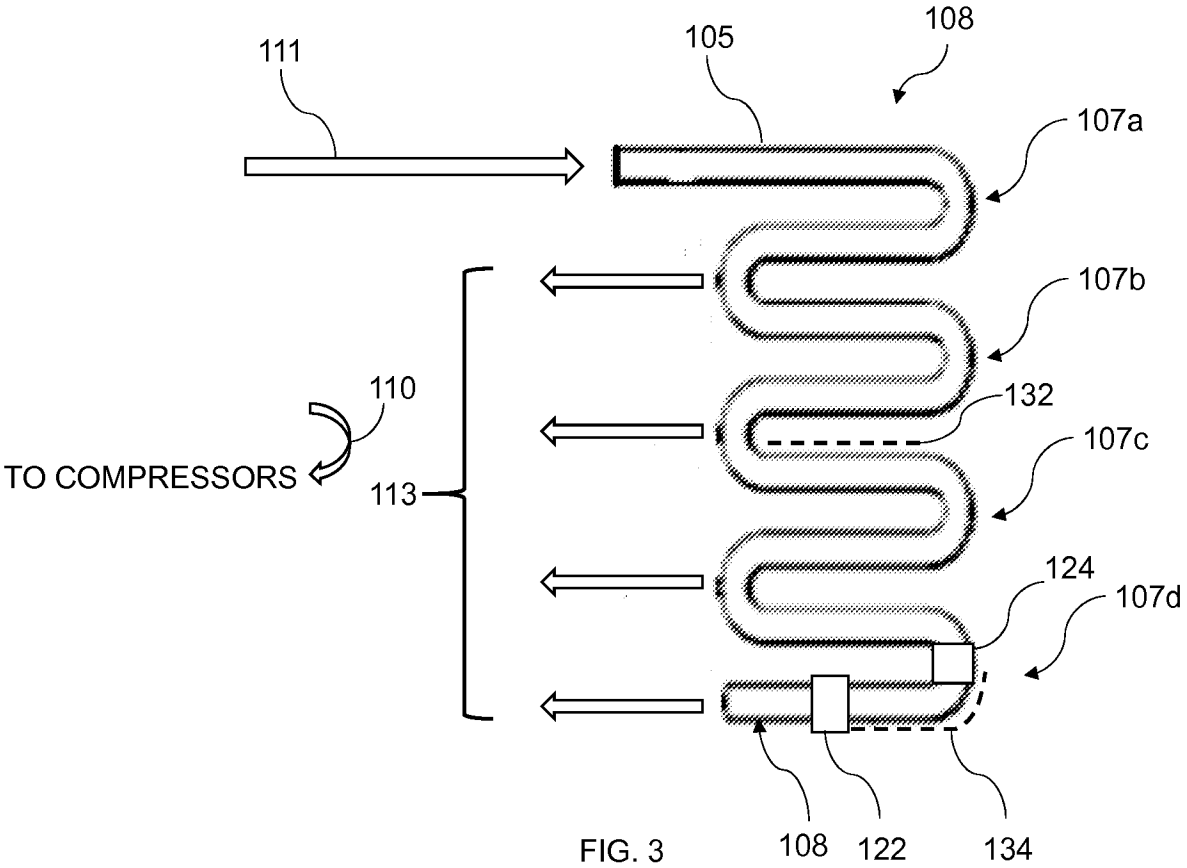
FIG. 3 illustrates an evaporator of an HVAC system operationally connected to temperature detecting devices.

Referring to FIG. 3, in the cooling circuit 110, the evaporator 108 receives low pressure, low temperature refrigerant 111 in a substantially liquid state in the cooling circuit 110. The evaporator 108 may comprise coils 105 having curvatures 107*a-d* configured for the exchange of heat between air and the refrigerant within the coils 105. The second fluid moving device 103, shown in FIG. 1, may be configured to adjust the flow of the second heat transfer media (e.g. air) over the coils 105 and through the evaporator 108. As illustrated in FIG. 3, gaseous refrigerant 113 exits the evaporator 108 and returns to the tandem compressor assembly 100 to complete the cooling cycle 110.

Figure 5:
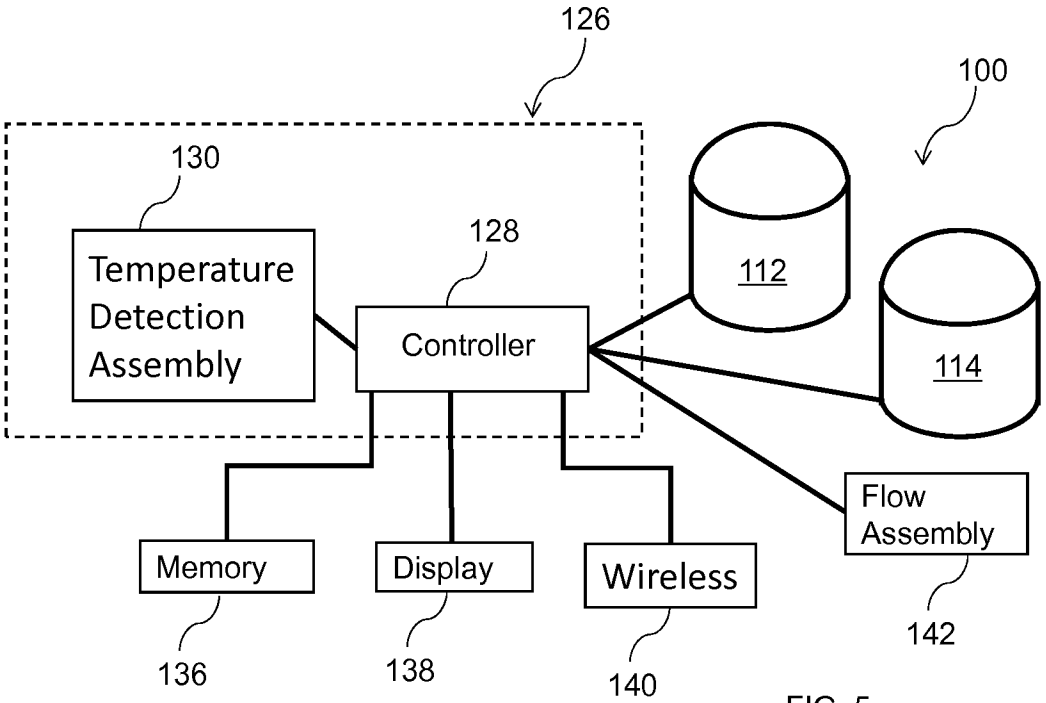
FIG. 5 shows a schematic of a control assembly operationally connected to a tandem compressor assembly.

Referring to FIG. 1, a control assembly 126 may be operationally connected to the tandem compressor assembly 100. Referring to FIG. 5, the control assembly 126 may comprise a controller 128 operationally connected to the tandem compressor assembly 100 configured to control operation of the tandem compressor assembly 100.

Referring to FIG. 5, the control assembly 126 may further comprise the controller 128 operationally connected to a temperature detecting assembly 130 and the flow assembly 142. The temperature detecting assembly 130 may comprise one or more temperature detecting devices configured to detect an abnormal temperature condition of refrigerant in the coils 105.

Referring to FIG. 3, a first temperature detecting device 122 of the temperature detecting assembly 130 may be mounted on a first portion of the coils 105. A second temperature detecting device 124 of the temperature detecting assembly 130 may be mounted on a second portion of the coils 105.

The first temperature detecting device 122 and the second temperature detecting device 124 may be operationally connected to the coils 105 to detect and monitor the temperature of refrigerant in the coils 105 of the evaporator 108. The first temperature detecting device 122 and the second temperature detecting device 124 may allow the HVAC system 1000 to respond to an indication that the coils 105 are getting cold, for example nearing temperatures where condensation freezes on the coils 105, which effects performance of the HVAC system 1000. In response to an indication that the coils 105 are getting cold, the tandem compressor assembly 100 may be operated in a one-compressor configuration. The first temperature detecting device 122 and the second temperature detecting device 124 may also be utilized as a warning system to detect cooling evaporator coils in HVAC systems that operate with a single compressor.

In some embodiments, the first temperature detecting device 122 and the second temperature detecting device 124 comprise a freeze stat having a switch configured to sense the temperature of the refrigerant in the coils 105. The switch of the freeze stat may change states when the freeze stat senses a pre-set temperature.

Each temperature detecting device 122, 124 may be configured to detect a different temperature condition in the coils 105 and generate a signal to the controller 128. For example, a first temperature threshold of the first temperature detecting device 122 may be set at a temperature indicative of a pre-freezing condition. A pre-freezing condition may comprise the temperature of the exposed outer surface of the coils 105 at or approaching a temperature at or near the freezing point of water condensation collecting on the outer surface of the coils 105. The surface temperature of the coils 105 may correspond or relate to the temperature of the refrigerant flowing within the coils 105. For example, a pre-freezing condition may comprise the refrigerant flowing within the coils 105 at 39 degrees Fahrenheit, which may cool the exposed outer surface of the coils 105 to at or near 39 degrees Fahrenheit. In other embodiments, a pre-freezing condition may comprise a rate of decrease in temperature (i.e. cooling) of refrigerant in the coils 105.

A second temperature threshold of the second temperature detecting device 124 may be set at a temperature indicative of a freezing condition. A freezing condition may comprise the temperature of the exposed outer surface of the coils 105 at or below the freezing point of water condensation collecting on the outer surface of the coils 105, such as about 29 (twenty-nine) degrees Fahrenheit. The temperature thresholds of the temperature detecting devices 122, 124 may be pre-selected, pre-programmed, or adjustable to accommodate response by the controller 128 to detection of an abnormal temperature condition in the coils 105.

Normal temperature conditions of refrigerant within the coils 105, when the HVAC system 1000 is operating to meet a demand, are within the range 40-60 degrees Fahrenheit. The controller 128 may infer from the state of the first temperature detecting device 122 and the second temperature detecting device 124 that the refrigerant temperature in the coils 105 is within the range of normal temperature conditions when neither the first temperature detecting device 122 nor the second temperature detecting device 124 signals that the temperature of the coils is at a pre-freezing or freezing condition, respectively.

The indication of a pre-freezing condition in the coils 105, which may in some embodiments fall at the lower end of the range of normal temperature conditions, may prompt the controller 128 to take action to address the risk of a freezing condition. In some embodiments, a normal temperature condition may comprise a pre-freezing temperature that is trending warmer. For example, the temperature of refrigerant in the coils 105 may be measured at 38 degrees Fahrenheit at a first time and measured at 40 degrees Fahrenheit at a second time, indicating that the refrigerant is warming in response to operating state of the HVAC system toward normal conditions.

In other embodiments, the first temperature detecting device 122 and the second temperature detecting device 124 may comprise other types of sensing devices which directly or indirectly sense refrigerant temperature. For example, the first temperature detecting device 122 or the second temperature detecting device 124 may comprise a temperature sensor or a pressure detecting device. Each temperature detecting device 112, 124 of the temperature detecting assembly 130 may comprise a different type of device than the other devices.

Referring to FIG. 3, the first temperature detecting device 122 and the second temperature detecting device 124 may be mounted anywhere on the circuit 110 that would reflect the temperature of the refrigerant in the coils 105. For example, the temperature detecting devices 122, 124 may each be mounted on a portion of the coils 105, such as a straight portion 132 or the curvatures 107*a-d*, which may include as hairpin or return bend portions of the coils 105.

Referring to FIG. 3, the first temperature detecting device 122 and the second temperature detecting device 124 may be separated from one another by a spacing 134 taken along the length of the coils 105. The spacing 134 between detecting devices 122 and 124 may be configured to reflect the temperature of refrigerant in the coils 105.

Figure 4A:
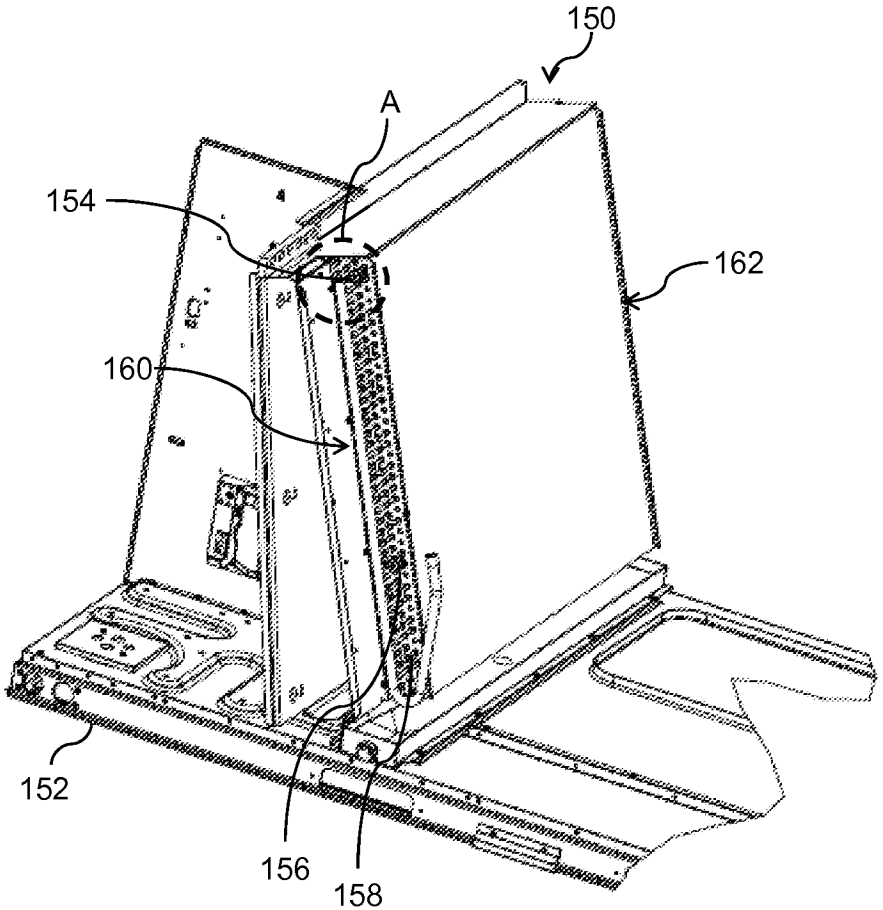
FIGS. 4A and 4B show a perspective view of an evaporator of an HVAC system operationally connected to freeze stats and a detailed view of a freeze stat mounted on a return bend of evaporator coils, respectively.
Figure 4B:
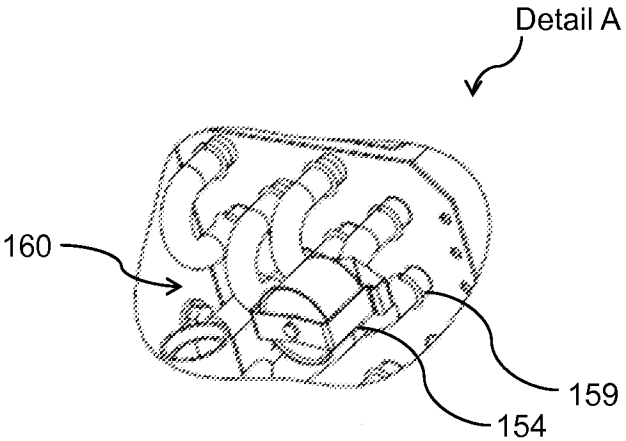

Referring to FIGS. 4A and 4B, there is shown an embodiment of an evaporator 150 mounted on a base portion 152 of the HVAC system 1000 (e.g. shown in FIGS. 1-3). Other well-known components of the HVAC system 1000 have been removed from the view of FIG. 4A for clarity.

A first freeze stat 154 and a second freeze stat 156 may be mounted onto evaporator coils 158 of the evaporator 150. The freeze stats 154, 156 may be configured to operate in the manner shown and described in FIG. 3. The first freeze stat 154 and the second freeze stat 156 may each be mounted onto curved portions of the evaporator coils 158. For example, as shown in FIG. 4B (a detail of area A shown in FIG. 4A), the first freeze stat 154 is mounted on a return bend 159 on the return side 160 of the evaporator 150. In other embodiments, one or more freeze stats may be mounted on the evaporator coils 158 extending on the hairpin side 162, shown in FIG. 4A, as an alternate location for one or more freeze stats.

Figure 6:
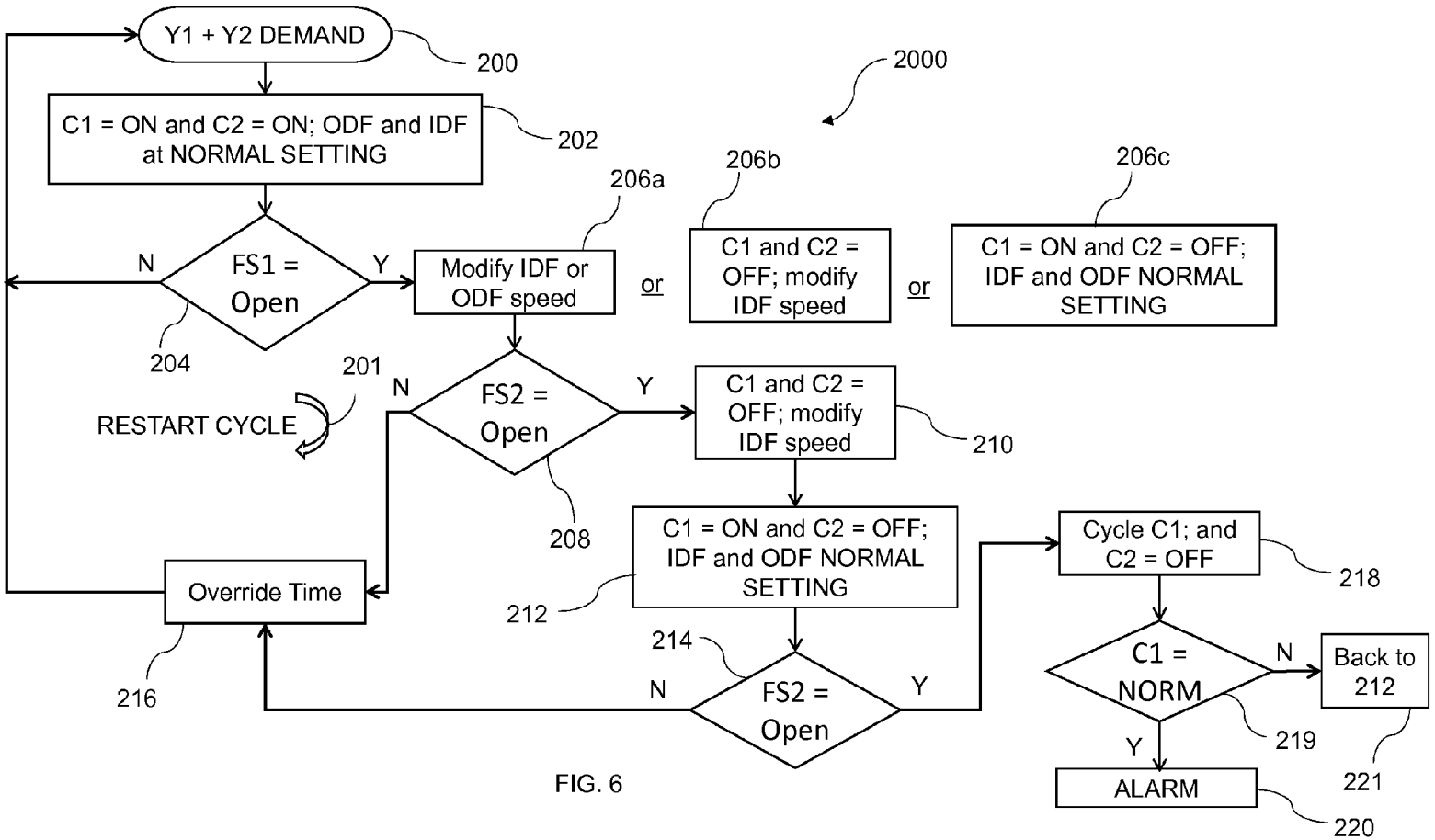
FIG. 6 shows a flow chart of operations of a method for controlling operation of an HVAC system.

Referring to FIG. 6, a method 2000 for controlling operation of an HVAC system having tandem compressors may comprise the HVAC system 1000 of FIGS. 1-4 configured to respond to detection of an abnormal temperature condition of refrigerant in coils of an evaporator. The abnormal temperature condition may comprise a pre-freezing condition or a freezing condition of the coils 105 of FIG. 2.

In operation 200 of the method 2000 shown in FIG. 6, the HVAC system 1000 may operate at an initial operational state to meet a first demand. The operational state may comprise one or more operational conditions that describe and characterize how the HVAC system 1000 is working at any given time. For example, the operational state may comprise the capacities of the compressors 112, 114 and the speed setting of the fluid moving devices 101, 103, among other operational conditions of the HVAC system 1000.

The HVAC system 1000 may operate at a full capacity comprising the capacity of the first stage Y1 plus the second stage Y2, as shown in operation 200. In other embodiments, the initial operational state may comprise operation at a reduced capacity, for example, the capacity of the first stage Y1. It will be understood that this method 2000 may be implemented in HVAC systems that do not utilize multi-stage operation.

In operation 202, the first compressor 112 (referred to as "C1") and the second compressor 114 (referred to as "C2") may be operating jointly to meet the first demand of the initial state of the HVAC system 1000. The first fluid moving device 101, for example an outdoor fan ("ODF"), and the second fluid moving device 103, for example an indoor fan ("IDF") may be operating at a "NORMAL SETTING" configured to accommodate the first demand of the initial state. The NORMAL SETTING may comprise a speed setting for each fan IDF and ODF configured to meet the first demand in the initial operational state.

Referring to FIG. 6, operation 204 may comprise the first temperature detecting device 122, for example a freeze stat, detecting an abnormal temperature condition in the refrigerant in the coils 105. A switch of the freeze stat may change states, for example from closed to open, to generate a signal to the controller 128 indicating a pre-freezing condition in the coils 105. In some embodiments, the temperature of refrigerant in the coils 105 is monitored by resetting an open switch of the freeze stat to a closed position to determine if the switch closes or "trips" due to the temperature sensed by the freeze stat.

In operation 206*a*, the controller 128 may respond to detection of an abnormal temperature condition by initiating a restart cycle 201 to return the HVAC system 1000 to normal operating conditions, e.g. operations 200 and 202. The restart cycle 201 may comprise one or more adjustments of one or more operating conditions of the HVAC system configured to raise the temperature of the refrigerant in the coils 105 to prevent freezing. The adjustments of the restart cycle 201 may allow the cooling period provided by the HVAC system 1000 to be extended by avoiding a complete and prolonged shutdown of the compressors 112, 114.

In some embodiments, the controller 128 may adjust the rate of heat transfer between the refrigerant flowing in the HVAC system 1000 and the environment. For example, the controller 128 may modify the speed of one or both of the first fluid moving device 101, for example an outdoor fan, and the second fluid moving device 103, for example an indoor fan. In some embodiments, the speed of the IDF is increased by 10% and the speed of the ODF is decreased by 10% from the NORMAL SETTING of the initial state. The adjustment of speed may be varied to accommodate the rate of heat transfer to the coils 105, other environmental conditions, and demands on the HVAC system 1000.

The controller 128 may monitor the temperature condition of the refrigerant in the coils 105. The controller 128 may receive a signal from the first temperature detecting device 122 indicating that the temperature in the coils 105 is no longer in an abnormal condition. For example, the switch of the first temperature detecting device 122 may return to a closed position or remain closed after a reset from the open position, indicating that the temperature is above the pre-freezing condition threshold (e.g. 39 degrees Fahrenheit). The controller 128 may return operation of the HVAC system 1000 to its initial state at operations 200 and 202 to complete the restart cycle 201.

Alternatively in operation 206*b* shown in FIG. 6, the controller 128 may respond to detection of an abnormal temperature condition in the coils 105 by shutting down both the first compressor 112 and the second compressor 114 and modifying the speed of the IDF. For example, the speed of the IDF may be increased by 20% from the NORMAL SETTING at the initial state in operations 200 and 202.

Adjustment of the IDF may be configured to meet demand requirements or to adjust heat exchange to respond to the pre-freezing condition in the coils 105. Operation 206*b* may be used as an alternative to operation 206*a* if, for example, the pre-freezing condition threshold is set closer to the freezing point in the coils 105.

Alternatively in operation 206*c* shown in FIG. 6, the controller 128 may respond to detection of an abnormal temperature condition in the coils 105 by operating the HVAC system 1000 in a one compressor configuration (i.e. C1=ON and C2=OFF). In some embodiments, the speed of the IDF and ODF may be additionally set at the NORMAL SETTING. In other embodiments, the speed of the IDF and ODF may be adjusted from the NORMAL SETTING to meet demand requirements or to adjust heat exchange to respond to the pre-freezing condition in the coils 105.

Operation 206*c* may be used as an alternative to operation 206*a* if, for example, the pre-freezing condition threshold is set closer to the freezing point in the coils 105. Other factors may contribute to selection of one of the operations 206*a*, 206*b*, or 206*c*, as alternatives to one another, including but not limited to detection of an abnormal rate of change of temperature in the coils 105 or an abnormal pressure in the coils 105 or other portion of the circuit 110.

In operation 208 shown in FIG. 6, the second temperature detecting device 124, for example a freeze stat, may monitor the temperature of refrigerant in the coils for an abnormal temperature condition. The switch of the second temperature detecting device 124 (e.g. a freeze stat in some embodiments) may change states from closed to open position, when the freeze stat senses that the temperature of the refrigerant is at a freezing condition for water condensation collecting on the coils 105. The freeze stat may generate a signal to the controller 128 indicating the freezing condition in the coils 105.

Following the initiation of operations 206*a, b*, or *c*, the second temperature detecting device 124 may report to the controller 128 that the temperature of refrigerant in the coils 105 has not reached a freezing condition. The controller 128 may continue operations 206*a, b*, or *c* for a time period (referred to as an "Override Time" and shown as operation 216) to allow the HVAC system 1000 to return to normal operating conditions (e.g. operations 200, 202), and complete the restart cycle 201. In some embodiments, the controller 128 may override during the Override Time the control logic employed to operate the HVAC system 1000 during normal operating conditions.

Referring to FIG. 6, the controller 128 may be further configured in operation 204 to receive an indication from the first temperature detecting device 122 that the coils 105 are no longer in a pre-freezing condition and that the refrigerant in the coils 105 has returned to normal operating temperatures. This indication may further confirm that the restart cycle 201 is complete.

In some embodiments, the Override Time is preset time period configured to allow time for the temperature of the refrigerant in the coils 105, and other operating conditions of the HVAC system 1000 to return to normal. In some embodiments, the Override Time may comprise about an hour. In other embodiments, the Override Time may be calculated by the controller 128 based on the known operating state of the HVAC system 1000, the demand on the HVAC system 1000, and other environmental conditions.

Detection of a freezing condition in the coils 105 by the second temperature detecting device 124, in operation 208, may indicate that the actions taken in operation(s) 206*a, b*, or *c* were not effective in preventing a drop in temperature of the refrigerant in the coils 105 from a pre-freezing condition to a freezing condition. The controller 128, in operation 210 shown in FIG. 6, may respond to detection of freezing condition by shutting down both the first compressor 112 and the second compressor 114 and adjusting the speed of the IDF. For example, the speed of the IDF may be increased by 20% from the NORMAL SETTING at the initial operational state in operations 200 and 202.

Referring to FIG. 6, operation 210 may be configured to quickly return the temperature in the coils 105 to at least a pre-freezing condition by shutting down both compressors 112, 114. From the perspective of the user, this configuration may not be desirable since the HVAC system 1000 is no longer delivering cooled air to the enclosed space.

Referring to FIG. 6, operation 210 may further be configured to minimize the shut-off time that both compressors 112, 114 are shut-off. In some embodiments, the time is pre-set to 5 minutes. In other embodiments, the shut-off time may be calculated by the controller 128 based on the known operating state of the HVAC system 1000, the demand on the HVAC system 1000, and other environmental conditions. The controller 128 may adjust other operating conditions to further minimize shut-off time, for example adjusting the speed of the IDF and ODF.

Following operation 210, the controller 128, in operation 212, may operate the HVAC system 1000 in a one-compressor configuration, i.e. with either the first compressor 112 on and the second compressor 114 off, or vice versa. Operation 212 may continue for a one-compressor time period. This one-compressor time period may be preset or calculated by the controller 128 to allow time for the refrigerant in the coils 105 to return to at least a pre-freezing condition.

The selection of which compressor 112, 114 to operate in the one-compressor configuration may depend on the capacity of the compressor 112 or 114 and the required demand on the HVAC system 1000. For example, one compressor may comprise a larger total capacity, which may be utilized to meet the demand on the HVAC system 1000, instead of the smaller capacity compressor.

In some embodiments, the speed of the IDF and ODF may be additionally set at the NORMAL SETTING. In other embodiments, the speed of the IDF and ODF may be adjusted from the NORMAL SETTING to meet demand requirements or to adjust heat exchange to respond to the pre-freezing condition in the coils 105.

Following the initiation of operation 212 shown in FIG. 6, the second temperature detecting device 124 may report to the controller 128, in operation 214, that the temperature of refrigerant in the coils 105 is no longer at a freezing condition, for example, when the switch of the freeze stat returns to a closed position or remains closed after a reset. In operation 216, the controller 128 may continue the actions undertaken in operation 212 for duration of the Override Time to allow the HVAC system 1000 to return to normal operating conditions (e.g. operations 200, 202), and complete the restart cycle 201.

Continued detection of a freezing condition in the coils 105 by the second temperature detecting device 124, in operation 214, may indicate that the actions taken in operation(s) 210 or 212 or both were not effective in preventing a freezing condition in the coils 105. The controller 128, in operation 210, may respond to continued detection of freezing condition, for example by shutting down both the first compressor 112 and the second compressor 114 and modifying the speed of the IDF.

After expiration of the one-compressor time period in operation 212 shown in FIG. 6, a continued detection a freezing condition in the coils 105 may prompt operation 218. The compressor that was operated in operation 212 (the "ON compressor") may be cycled by being shut down and then powered back on. The cycling of the ON compressor may allow the controller 128 to test whether the ON compressor is malfunctioning in operation 219. The controller 128 may receive other diagnostic data from the ON compressor to assist in evaluation of the operability of the ON compressor.

In response to a determination that the ON compressor is operating normally in operation 219, the controller 128 may issue an alarm (operation 220 shown in FIG. 6) and terminate the restart cycle 201. The alarm may be an indication to the user that the HVAC system 1000 is malfunctioning and cannot be returned to its operational state (e.g. operations 200 and 202) without further diagnostics and repair.

In response to a determination that the ON compressor is malfunctioning in operation 219, the controller 128, in operation 221, may re-initiate operation 212 operating the HVAC system 1000 in a one-compressor configuration. The initial ON compressor (i.e. C1) may be shut down and the other compressor (i.e. C2) may be operated as the ON compressor in the one-compressor configuration.

Referring to FIG. 6, operation of compressor C2 as the ON compressor in the HVAC system 1000 may proceed to operation 218, i.e. cycling of the ON compressor, if there is a continued detection of a freezing condition in the coils 105 (operation 214). If there is a determination by the controller 128, in operation 219, that the ON compressor is operating normally but that the adjustments to the operating condition of the HVAC system 1000 have not resolved the freezing condition in the coils 105, then an alarm may be generated, according to operation 220. If there is a determination in operation 219 that both compressors are malfunctioning, then an alarm may be generated, according to operation 220.

The alarm of operation 220 may be generated in conjunction with other operations of the method 2000, shown in FIG. 6. For example, an alarm may be generated when the controller 128 first detects a pre-freezing condition. Or an alarm may be generated when the operations 206*a-c*, 210, or 212 do not resolve the pre-freezing or freezing condition. Such alarms may be useful to users and diagnosticians in later troubleshooting the cause of the pre-freezing or freezing condition.

The alarm of operation 220 may comprise an electronic communication. The communication may comprise a textual or visual summary of data regarding operation of the HVAC system 100, including a characterization of temperature of the refrigerant in the coils 105, such as a chart, graph, or table. The communication may also include information regarding the operability of the compressors 112, 114, and any other information collected or calculated based on the operations of method 2000.

The communication may be sent to a display, stored in memory, or communicated directly to a third party. Referring to FIG. 5, the communication may be stored in a memory log 136 operationally connected to the controller 128. The temperature of refrigerant in the coils 105 may be sent to a display 138. For example, a diagnostician may be connected to a port (not shown) operationally connected to the controller 128 and may request a reading of the coil temperature, or may access the memory log 136 that contains a history of the coil temperature for a given time period. In other embodiments, the communication, e.g. an alarm, generated by the controller 128 in operation 220 may be sent via a wireless device 140, for example as an email or text message.

The HVAC system 1000 may be operated in one or more restart cycles in response to detection of pre-freezing condition in the coils 105. In operation 214, for example, determination that the actions taken by the controller 128 in operations 210 or 212 or both or other actions taken in the restart cycle 201 were not effective in preventing a freezing condition in the coils 105 in a first restart cycle may prompt the controller 128 to initiate a second restart cycle. The initiation of a second restart cycle may be instead of or in conjunction with generation of an alarm in operation 220.

The second restart cycle may contain some or all of the operations of the first restart cycle 201 (e.g. shown in FIG. 6). In some embodiments, the controller 128 may begin the second restart cycle at either operation(s) 206*a-c* or 210, depending on the desired demand on the HVAC system 1000, environmental conditions, and the detected temperature of refrigerant in the coils 105.

It will be understood by persons of ordinary skill in the art that the controller 128 may comprise one or more processors and other well-known components. The controller 128 may further comprise components operationally connected but located in separate in locations in the HVAC system 1000, including operationally connected by wireless communications. For example, the controller 128 may comprise a first controller unit located on an outside portion of the HVAC system (where the compressor and condenser may be), a second controller unit located on an inside portion (where the evaporator may be), a thermostat for monitoring environmental conditions (on a wall of an enclosed space), and a control unit accessible for user input (embodied on a hand-held wireless unit). The controller 128 may further comprise a timing function for measuring the time periods disclosed herein.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

We claim:

1. A control system for operating a heating, ventilation, and air conditioning (HVAC) system, the control system comprising:

a control assembly configured to operationally connect to a compressor assembly and a flow assembly of an HVAC system, wherein the control assembly is configured to operate the HVAC system in at least a first operational state to meet a first demand on the HVAC system;

wherein the control assembly comprises a controller configured to control operation of a first compressor unit and a second compressor unit of the compressor assembly, wherein the first compressor unit and the second compressor unit operate in tandem to pump a first heat transfer media through the HVAC system, and wherein the first compressor unit and the second compressor unit operate at a first capacity to maintain the HVAC system in the first operational state;

wherein the controller is configured to control operation of a first fluid moving device of the flow assembly, wherein the first fluid moving device is configured to pass a second heat transfer media over coils of an evaporator of the HVAC system to transfer heat to the first heat transfer media flowing through the coils, and wherein the first fluid moving device comprises a first speed setting configured to maintain the HVAC system in the first operational state; and wherein the controller is configured to detect a pre-freezing condition in the coils, and, in response to detection of the pre-freezing condition the controller operates the HVAC system in at least one restart cycle, wherein the at least one restart cycle comprises at least a first adjustment of an operating condition of the HVAC system, and wherein the first adjustment is selected from the following:

increasing the speed of the first fluid moving device from the first speed setting to a second speed setting, wherein the second speed setting is configured to adjust heat transfer to the coils to raise the temperature of the first heat transfer media in the coils, and operating the HVAC system with the first compressor unit on and the second compressor unit off.

2. The control system of claim 1, wherein the controller is configured to control operation of a second fluid moving device of the flow assembly, wherein the second fluid moving device is configured to move the second heat transfer media through a condenser of the HVAC system to remove heat from the first heat transfer media flowing through the condenser, and wherein the second fluid moving device comprises a third speed setting configured to maintain the HVAC system in the first operational state; and wherein the first adjustment comprises increasing the speed of the first fluid moving device from the first speed setting to a second speed setting and decreasing the speed of the second fluid moving device from the third speed setting to a fourth speed setting.

3. The control system of claim 2, wherein the controller is configured to detect a normal temperature condition of the first heat transfer media in the coils, and wherein the at least one restart cycle further comprises, in response to detection of the normal temperature condition, the controller operates the HVAC system according to the first adjustment for a first time period.

4. The control system of claim 2, wherein the at least one restart cycle further comprises: a second adjustment of an operational condition of the HVAC system, the second adjustment comprising the controller detecting a freezing condition in the coils, and, in response to detection of the freezing condition, shutting both the first compressor unit and the second compressor unit off and increasing the speed of the first fluid moving device from the second speed setting to a fifth speed setting to increase heat transfer to the first heat transfer media in the coils.

5. The control system of claim 2, wherein the at least one restart cycle further comprises: a third adjustment of an operational condition of the HVAC system, the third adjustment comprising the controller detecting a freezing condition in the coils, and, in response to detection of the freezing condition, the controller operating the first compressor unit on and the second compressor unit off.

6. The control system of claim 2, wherein the at least one restart cycle further comprises: a second adjustment of an operational condition of the HVAC system, the second adjustment comprising the controller detecting a freezing condition in the coils, and, in response to detection of the freezing condition, shutting off both the first compressor unit and the second compressor unit and increasing the speed of the first fluid moving device from the second speed setting to a fifth speed setting to increase heat transfer to the first heat transfer media in the coils; wherein both the first compressor unit and the second compressor unit remain shut off and the first fluid moving device is operated at the fifth speed setting for a second time period; and wherein, following operation of the HVAC system according to the second adjustment for the second time period, a third adjustment of an operational condition of the HVAC system, the third adjustment comprising, the controller operating the first compressor unit on and the second compressor unit off.

7. The control system of claim 6, wherein in response to detection of a normal temperature condition in the coils, the at least one restart cycle further comprises the controller operating the HVAC system according to the third adjustment for a third time period.

8. The control system of claim 6, wherein the at least one restart cycle further comprises: the controller operating the HVAC system according to the third adjustment for a fourth time period, and wherein following expiration of the fourth time period and in response to a continued detection of the freezing condition in the coils, the controller generates an alarm signal.

9. The control system of claim 6, wherein the at least one restart cycle further comprises: the controller operating the HVAC system according to the third adjustment for a fourth time period, and wherein following expiration of the fourth time period and in response to a continued detection of the freezing condition in the coils, the controller cycles the first compressor on and off to determine whether the first compressor unit is malfunctioning.

10. The control system of claim 5 further comprising:

a first temperature detecting device and a second temperature detecting device, wherein the first temperature detecting device and the second temperature detecting device are configured to measure the temperature of the first heat transfer media in the coils; and wherein the first temperature detecting device is configured to generate a first temperature signal to the controller when the first heat transfer media in the coils is in a pre-freezing condition and wherein the second temperature detecting device is configured to generate a second temperature signal to the controller when the first heat transfer in the coils is in a freezing condition.

11. The control system of claim 10, wherein the first temperature detecting device and the second temperature detecting device each comprise a freeze stat operationally connected to the coils for detecting the temperature of the first heat transfer media in the coils, and wherein the pre-freezing condition comprises about 39 degrees Fahrenheit and the freezing condition comprises about 29 degrees Fahrenheit, and wherein the first heat transfer media comprises refrigerant, and the second heat transfer comprises air.

12. A method for controlling operation of a heating, ventilation, and air conditioning (HVAC) system, the method comprising:

providing a control assembly configured to operationally connect to a compressor assembly and a flow assembly of an HVAC system, wherein the control assembly is configured to operate the HVAC system in at least a first operational state to meet a first demand on the HVAC system;

wherein the control assembly comprises a controller configured to control operation of a first compressor unit and a second compressor unit of the compressor assembly, wherein the first compressor unit and the second compressor unit operate in tandem to pump a first heat transfer media through the HVAC system, and wherein the first compressor unit and the second compressor unit operate at a first capacity to maintain the HVAC system in the first operational state;

wherein the controller is configured to control operation of a first fluid moving device of the flow assembly, wherein the first fluid moving device is configured to move a second heat transfer media over coils of an evaporator of the HVAC system to transfer heat to the first heat transfer media flowing through the coils, and wherein the first fluid moving device comprises a first speed setting configured to maintain the HVAC system in the first operational state; and detecting, by the controller, a pre-freezing condition in the coils;

operating, by the controller, the HVAC system in at least one restart cycle in response to the detection of a pre-freezing condition in the coils; and wherein a first restart cycle comprises at least a first adjustment of an operating condition of the HVAC system, the first adjustment selected from the following:

increasing, by the controller, the speed of the first fluid moving device from the first speed setting to a second speed setting, wherein the second speed setting is configured to adjust heat transfer to the coils to raise the temperature of the first heat transfer media in the coils, and operating, by the controller, the HVAC system with the first compressor unit on and the second compressor unit off.

13. The method of claim 12, further comprising:

wherein the controller is configured to control operation of a second fluid moving device of the flow assembly, wherein the second fluid moving device is configured to pass the second heat transfer media through a condenser of the HVAC system to remove heat from the first heat transfer media flowing through the condenser, and wherein the second fluid moving device comprises a third speed setting configured to maintain the HVAC system in the first operational state; and the first adjustment further comprising:

increasing, by the controller, the speed of the first fluid moving device from the first speed setting to a second speed setting and decreasing the speed of the second fluid moving device from the third speed setting to a fourth speed setting.

14. The method of claim 13, the first restart cycle further comprising: detecting, by the controller, a normal temperature condition of the first heat transfer media in the coils; and in response to detection of the normal temperature condition, operating, by the controller, the HVAC system according to the first adjustment for a first time period.

15. The method of claim 13, the first restart cycle further comprising:

detecting, by the controller, a freezing condition in the coils; and a second adjustment of an operating condition of the HVAC system, the second adjustment comprising:

in response to detection of the freezing condition, shutting down, by the controller, both the first compressor unit and the second compressor unit off and increasing the speed of the first fluid moving device from the second speed setting to a fifth speed setting to increase heat transfer to the first heat transfer media in the coils.

16. The method of claim 13, the first restart cycle further comprising:

detecting, by the controller, a freezing condition in the coils; and a third adjustment of an operating condition of the HVAC system, the third adjustment comprising:

in response to detection of the freezing condition, operating, by the controller, the first compressor unit on and the second compressor unit off.

17. The control system of claim 16, the first restart cycle comprising:

detecting, by the controller, a normal temperature condition in the coils;

operating, by the controller, the HVAC system according to the third adjustment for a third time period.

18. The control system of claim 16, the first restart cycle comprising: operating, by the controller, the HVAC system according to the third adjustment for a fourth time period; and wherein following expiration of the fourth time period and in response to a continued detection of the freezing condition in the coils, generating, by the controller, an alarm signal.

19. The control system of claim 16, further comprising:

operating, by the controller, the HVAC system in second restart cycle; and wherein the second restart cycle comprises at least a fourth adjustment of an operating condition of the HVAC system, the fourth adjustment comprising operating, by the controller, the first compressor unit on and the second compressor unit off.

* * * * *